US005146865A

United States Patent [19]

Lais et al.

[11] Patent Number: 5,146,865

[45] Date of Patent: Sep. 15, 1992

[54] WATER-JET PROPULSION SYSTEM FOR SHIPS WHICH ARE INTENDED TO BE USED IN SHALLOW WATERS

[75] Inventors: Siegfried Lais, Spay; Gerd Krautkramer, Remagen, both of Fed. Rep. of Germany

[73] Assignee: Schottel-Werft Joseph Becker GmbH & Co. KG, Spay, Fed. Rep. of Germany

[21] Appl. No.: 724,972

[22] Filed: Jun. 28, 1991

[30] Foreign Application Priority Data

Jul. 4, 1990 [DE] Fed. Rep. of Germany ..... 4021340

[51] Int. Cl.[5] ..... B63H 11/113

[52] U.S. Cl. ..... 114/151; 440/42

[58] Field of Search ..... 114/151; 440/38, 40, 440/42; 60/221, 222

[56] References Cited

U.S. PATENT DOCUMENTS 3,098,464 7/1963 Holland ..... 60/221 X 4,278,431 7/1981 Krautkremer et al. ..... 114/151 X

*Primary Examiner*—Sherman Basinger

*Attorney, Agent, or Firm*—Alan H. Levine; Howard F. Mandelbaum

[57] ABSTRACT

A water-jet propulsion system for ships, which are intended to be used in shallow waters. A semi-axial, bladed turbine wheel with a vertical axis of rotation is disposed so that it can rotate in a well-shaped pressure housing. Into the pressure housing, the driving mechanism for the turbine wheel is introduced from above through a cover plate. At the lower end, the pressure housing is closed off by a bottom plate, which has a concentric, centrally disposed water inlet for axial flow against the turbine wheel and at least one water outlet with a shallow inclination. A guiding apparatus in which the flow energy of the water conveyed by the turbine wheel is largely converted into pressure energy is disposed between the outlet end of the conveying channels of the turbine wheel and the at least one water outlet. A bottom plate is structurally separated from the well-shaped pressure housing and its cover plate and the pressure housing is integrated into the load-bearing structure of the ship as a component of the same. The bottom plate together with the water inlet that is integrated into it and the at least one water outlet can be rotated continuously about the longitudinal axis of the pressure housing in both circumferential directions.

15 Claims, 2 Drawing Sheets

Fig.1
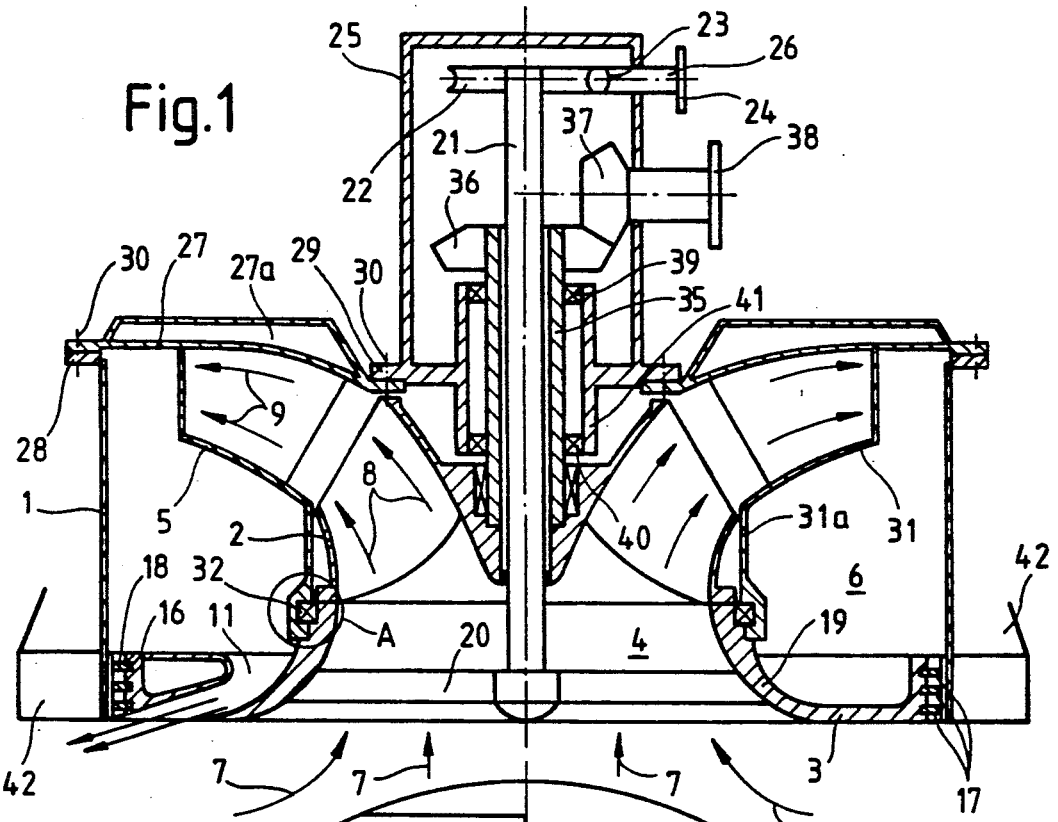
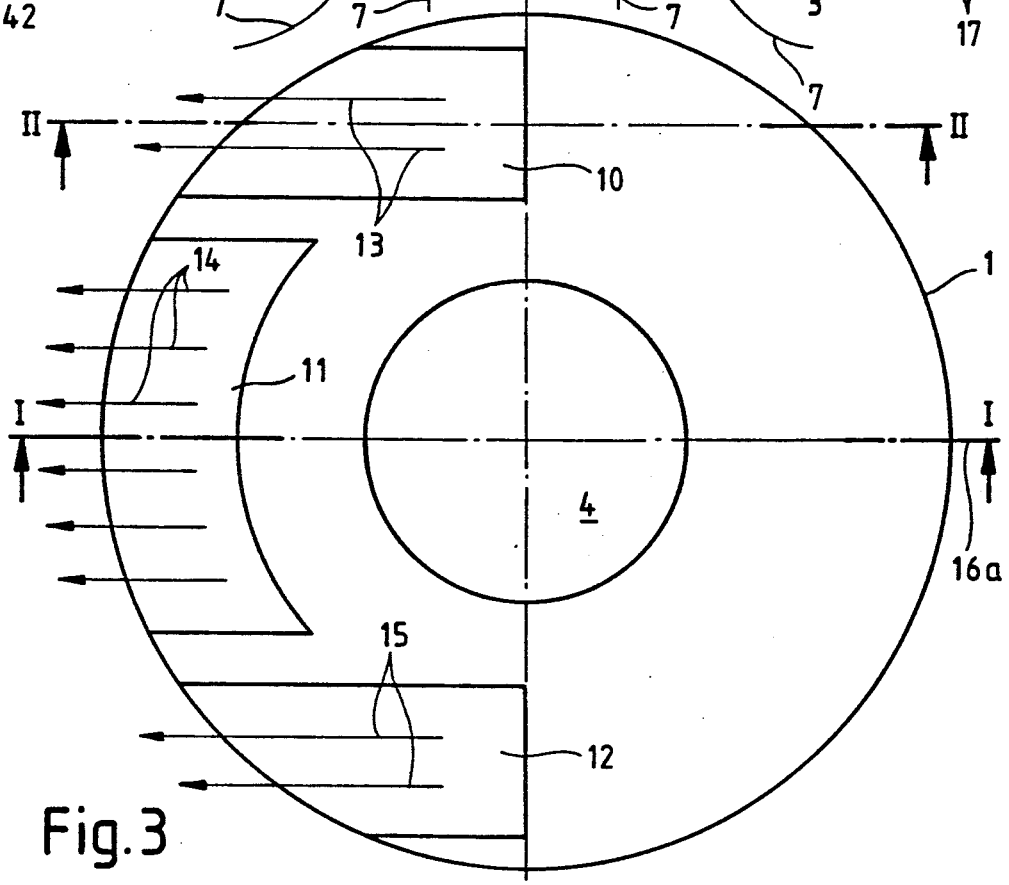
Fig.3

WATER-JET PROPULSION SYSTEM FOR SHIPS WHICH ARE INTENDED TO BE USED IN SHALLOW WATERS

In the case of a so-called pumpjet, as used in the state of the art practiced up to now, a vertical, tubular shaft is built into the hull of the ship. The lower end of this shaft lies in an essentially horizontal plane which accommodates the generally flat bottom of the type of ship which is intended to be used also in extremely shallow waters. A semi-axial turbine wheel, which can rotate about a vertical axis that coincides with the longitudinal axis of the shaft, is disposed in the shaft. This turbine wheel takes in water axially at its inlet and conveys it obliquely upwards. The conveyed water reaches a spiral housing, from which it emerges through a nozzle. The energy of the jet determines the speed of propulsion of the ship and the direction of the jet determines the direction of movement of the ship. At the bottom, the shaft is closed off by a cover, in which an intake opening for the water to be taken in by the turbine wheel is disposed concentrically.

This principle was abandoned in a so-called pot pump of the German Offenlegungsschrift 37 35 699, insofar as the turbine wheel, instead of pumping into a spiral housing, pumps into a stationary vane ring, which is constructed so that the flow energy, which is present at the inlet ends of the flow channels, is converted as far as possible into pressure energy at the outlet ends of these channels. The shaft is not built immovably into the hull of the ship, but is a pressure housing, which can rotate about its longitudinal axis. Together with the bottom plate, it encloses a pressure chamber, in which the pumped water is under the same pressure as the water at the outlet end of the vane ring. At any place in the pressure housing or "pot", an outlet opening can be mounted, in order to bring about the propulsion of the ship and to determine the direction of propulsion and travel of the ship. Instead of this one outlet opening, a plurality of outlet openings can also be provided in appropriate coordination with one another and with the housing. The outlet direction of the jet or jets leaving the pressure housing can also be determined by swivelling the pressure housing in order to be able to determine the direction of thrust or travel of the ship by these means. In this way, a propulsion system is disclosed, which can be regarded as novel. However, it is not stated how this principle can be converted into practice.

The present invention starts at this point, and provides a construction of such a pot pump, which can be realized in practice in a particularly appropriate manner. The pump is described in greater detail below by means of the drawings, in which the following are shown:

FIG. 1 is a vertical cross-sectional view along line I—I of FIG. 3;

FIG. 3 is a view of the underside of the pump of FIGS. 1 and 2;

Figure 2:
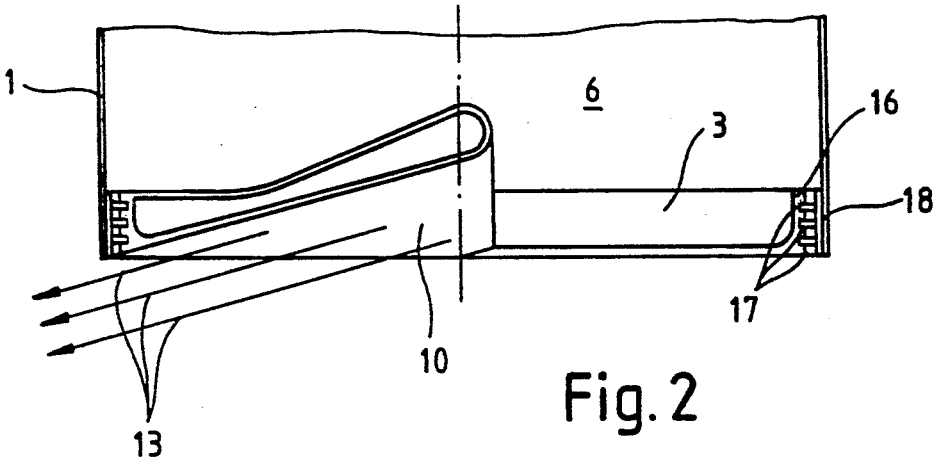
FIG. 2 is a corresponding sectional view along the line II—II of FIG. 3.

As is already known, the propulsion system of this invention has a cylindrical or pot-shaped pressure vessel 1, having a vertical longitudinal axis which is built into the ship. The pressure vessel 1 is closed off below by a bottom plate 3 and above by the cover plate 27 that is reinforced with ribs 27*a* and accommodates the semi-axial, bladed turbine wheel 2 coaxially to its longitudinal axis. Downstream of turbine wheel 2 there is a vane ring 5, which converts, as much as possible, the flow energy which exists in the regions of the outlet edges of the blades of the turbine wheel 2 into pressure energy. The axial water inlet 4 into the pressure housing 1 is integrated into the bottom plate 3, concentrically with the the longitudinal axis of the housing. The housing also contains three outlet nozzles 10, 11, 12 disposed and constructed symmetrically to a vertical diametrical plane 16*a* (FIG. 2).

The water, taken in axially through inlet 4, is directed in the turbine wheel 2 in an obliquely upwards direction and, after the guiding apparatus with the vane ring 5, is delivered to the outlet nozzles 10 to 12, so as to leave these in an obliquely downwards direction (FIG. 1). Accordingly, in the pressure chamber 6 of the pressure housing 1, there is only a very slight flow, because the flow energy is converted to the greatest extent possible into pressure energy. The course of the flow from the central inlet opening 4 in the bottom plate 3 up to the entry into the pressure chamber 6 or to the end of the flow channels of the vane ring is indicated by arrows 7 (intake), 8 (passage through the flow channels of the turbine wheel 2) and 9 (passage through the flow channels of the vane ring). The water leaves the pressure chamber 6 through the three outlet nozzles 10, 11 and 12, as indicated by the arrows 13, 14 and 15.

These outlet nozzles 10, 11 and 12 are integrated into the bottom plate 3 and are directed parallel to one another obliquely downwards. Since the three outlet nozzles 10, 11 and 12 are disposed symmetrically with respect to the vertical longitudinal center plane 16 in the plan view of FIG. 3, the rudder moments, which arise during all-around steering, are the same in either direction of rotation, clockwise or anti-clockwise, and are, moreover, very small. This simplifies the mounting of the propulsion system and facilitates the steering of the ship.

Figure 5:
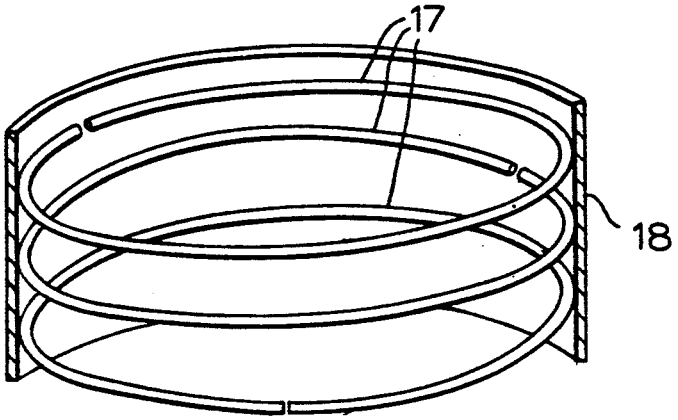
FIG. 5 is a view of the packing rings.

As distinguished from the state of the art, there is no mechanical connection between the cylindrical pressure housing 1 and the bottom plate 3. There is, instead, an annular gap between the wall of the pressure housing and the bottom plate 3, which is made water-tight by seals. For this purpose, packing rings 17 are held in a vertical, cylindrical edge 16 of the bottom plate. These packing rings 17 lie against a ring-shaped, wear-resistant, rustproof insert 18, which reinforces the shaft 1 in the region of its lower margin. Each of the three packing rings 17 which are provided, consists of a sealing material and is an open ring, which is compressible radially. Relative to the two other rings, each ring is installed so that the joints of the three open rings are as small as possible and, in addition, are mutually offset in the circumferential direction, so that the joint of the ring in the middle lies behind an uninterrupted section of the packing ring lying above it as well as of the packing ring lying below it. Moreover, the joint of the uppermost ring is offset in the circumferential direction relative to the joint of the lowest packing ring. A labyrinth seal, which is optimum with respect to the operating conditions, is thus formed. The offsetting of the joints of the three open rings 17 is shown in FIG. 5.

The water inlet 4, which is integrated into the bottom plate 3, is an inwardly pointing cuff-shaped distributor 19, which has a contour that favors and limits the flow and, at the same time, functions with ribs 20 as an intake protective grating. Over several of these radial ribs 20, a control shaft 21 is held fast at its lower end concentrically in the inlet 4. In this way, rotational movements of the control shaft 21 can be transferred in both circumferential directions over the cross members 20 to the bottom plate 3, in order to be able to change the direction of the water jets 13, 14, 15 leaving the water nozzles 10 to 12.

The rotational movement of the control shaft 21 is brought about by way of toothed gearing 22, 23, the flange 24 of which is mounted in a power-transferring manner on the drive shaft of a suitable servomotor, which is not shown. The upper end of the control shaft 21 and the toothed gearing 22, 23 are disposed in a dome-shaped housing 25. The toothed gearing is a worm gearing, the worm 23 of which, together with its shaft 26, is led out of the housing 25 and, outside of the housing 25, carries the connecting flange 26 at its end. Worm wheel 22, on the one hand, and worm 23, shaft 26 and flange 24, on the other, are disposed in different planes, which are parallel to the plane of the paper, so that the worm 23 is brought forward tangentially to the worm wheel 22, particularly on the rear of this wheel, and engages it.

The housing cover plate 27 is disposed between the pressure housing 1 and the dome-shaped housing 25. This plate 27 is constructed as a doughnut disk plate with reinforcing rings 27*a*. It is detachably connected at the outer edge with the upper edge of the shaft or with a horizontal flange 28, which reinforces this upper edge, and, at the inner edge, with an annular flange 29 of the dome-shaped housing 25. Screwed connections 30 are shown schematically as the detachable means of fastening.

Figure 4:
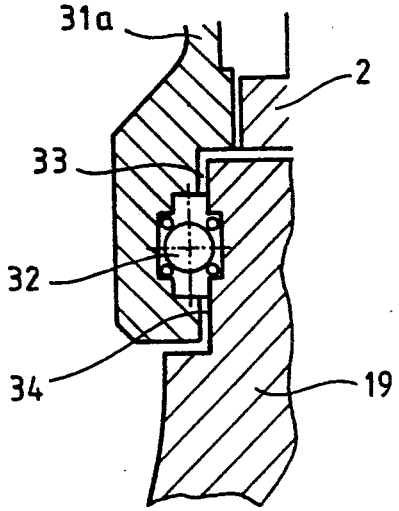
FIG. 4 is a detail of the arrangement, which is circumscribed by the circle A in FIG. 1, on a larger scale.

The blades of the vane ring 5 are fastened to the underside of the housing cover plate 27, the cover plate 27 being contoured so that it is one of the cover disks of the blade channel boundaries. The other cover disk 31 serves as the lower boundary of the blade channels and ends in a cylindrical section 31*a*. Between this cylindrical section 31*a* and the inlet distributor 19, there is a wire roller bearing 32, which is made from a rustproof steel and is lubricated by the surrounding medium (water). Foreign matter, such as dirt and sand, which may be in the medium, are kept away from the wire roller bearing 32 by felt rings 33, 34, which are also lubricated by the medium (FIG. 4). No oil or grease is required to lubricate this arrangement. The bearing does not pollute the environment and requires no maintenance. The whole of the bottom plate 3 can be rotated continuously about its longitudinal axis, which is the longitudinal axis of the control shaft 21, so that the whole of the horizontal thrust force is available for steering in any direction.

The control shaft 21 passes coaxially through the power-transfer shaft 35, which is constructed as a hollow shaft and terminates below the gearing 22, 23 in the dome-shaped housing 25. At its upper end, shaft 35 carries a conical gear wheel 36 in such a manner that there can be no rotation between them. The driving torque for the turbine wheel 2 is transferred to the gear wheel 36, and hence, to the power transfer shaft 35 by means of a mating gear 37 and its shaft, which is led out of dome-shaped housing 25. A coupling flange 38 on the shaft is driven by a suitable driving motor, which is not shown. The power-transfer shaft 35 is guided by means of two pivot bearings 39, 40, which are axially offset relative to one another, in a tube 41. The latter is held concentrically in the plane of the flange 29, in the dome-shaped housing 25, at the lower end of this housing 25. The two ends of the tube and the pivot bearings 39, 40 lie above and below this plane, respectively. Below the lower end of the tube 41, the turbine wheel 2 is mounted with its hub on the power-transfer shaft 35, so that there can be no rotary movement between shaft and hub.

Aside from the previously customary electric or hydraulic driving mechanism, the worm gearing 22, 23 can also be driven mechanically, wherein an advantage is seen. The reason for this possibility is that the rudder moments are the same in both directions of rotation and, above all, are very low. This is made possible primarily by the symmetric arrangement of the outlet nozzles 10 to 12 and the seal 17 that is constructed according to the invention.

The seal between the bottom plate 3 and the pressure housing 1, i.e., the labyrinth seal with the sealing piston rings 17, renders it possible to make do with low rudder moments. There is, namely, no stick-slip effect. If there were such an effect, the two parts, which are to be moved against one another and have to be sealed, would run the risk that, in the event of a stoppage, the seals would stick to one or both parts and, when the one part is started up again with considerable torque, would be torn off and destroyed. This danger does not exist in the case of the inventive use of the packing rings 17, which are constructed as open, radial, springy "piston rings". Nevertheless, the piston rings are constructed of wear resistant, synthetic material in "an open type of construction". In the built-in state, they are pretensioned radially, much like a spring. The pressure in the pressure chamber 6 does not cause any increase in the friction, which would impede the rotation of the turbine wheel 2.

The whole of the propulsion mechanism can be assembled and disassembled, while leaving the pressure housing 1 in the ship's structure. For this reason, the pressure housing 1 can be integrated as part of the load-bearing structure 42 of the ship.

The aforementioned insert 18 is constructed as a wear ring of rustproof steel and is welded in place or otherwise fastened, for example by shrinking. It serves as a bearing surface for the rotor, against which the seals 17 lie.

The inner wall of the pot or pressure housing 1, above the insert 18, is obviously smooth and without any steps or shoulders. The bottom plate 3 with the turbine wheel 2, guiding apparatus 5, 27*a*, 31 and pressure housing cover 27 with ribs 27*a* form a structural unit, which is supported on the upper end of the pressure housing and is detachably connected there with the pressure housing. After the connections are loosened, this structural unit can therefore be disassembled in an upward direction. At the upper end, the structural unit is detachably connected to the pressure housing, while at the lower end the packing rings provide a horizontal, resiliant seal with the pressure housing. This seal functions reliably over long operating periods, even when faced with unavoidable manufacturing inaccuracies, particularly circularity errors.

It follows from all of the advantages described for the use of springy, piston ring-like packing rings 17 that the use of such rings is an important advance, which is independent of the particular construction of the turbine wheel and the pot pump.

The three compressed water outlets 10 to 12, which are disposed symmetrically to the vertical diametrical plane 16*a*, were found to be the optimum solution pursuant to the invention. However, it is also possible, if necessary, to make do with the one outlet nozzle 11 or with the pair of outlet nozzles 10, 12, provided that the one outlet nozzle 11 or the pair of outlet nozzles 10, 12 is disposed symmetrically to the diametrical plane 16*a*.

We claim:

1. A water-jet propulsion system for ships which are intended to be used in shallow waters, comprising:

a cylindrical pressure housing adapted to be fixed with respect to the ship with which it is used, a bottom plate having a central inlet opening through which water can flow into the pressure housing, the bottom plate being rotatable with respect to the pressure housing and having at least one water outlet nozzle, a cover plate secured to the pressure housing, the pressure housing, bottom plate, and cover plate defining between them an annular pressure chamber, a turbine wheel rotatable with respect to the pressure housing for drawing water upwardly through the opening in the bottom plate, guide means for directing water pumped by the turbine wheel into the pressure chamber, the pressure chamber being so sized with respect to the guide means that the flow energy of the water flowing from the turbine wheel through the guide means is converted to pressure energy in the pressure chamber, the water leaving the pressure chamber through the outlet nozzle in the bottom plate to propel the ship, and means for rotating the bottom plate so as to change the orientation of the outlet nozzle with respect to the ship and thereby guide the direction of the ship.

2. A water-jet propulsion system as defined in claim 1 including an annular gap between the periphery of the bottom plate and the pressure housing, and a seal within the gap.

3. A water-jet propulsion system as defined in claim 1 wherein the bottom plate, turbine wheel, and guide means are all supported by the cover plate, and the diameter of the pressure housing is large enough throughout its length to permit those part to pass through it, so that upon disconnecting the cover plate from the pressure housing, the bottom plate, turbine wheel, and guide means can be lifted out of the pressure housing together with the cover plate.

4. A water-jet propulsion system as defined in claim 1 wherein the bottom plate has three outlet nozzles symmetrically arranged with respect to a vertical plane containing the axis of the inlet opening.

5. A water-jet propulsion system as defined in claim 1 wherein the portion of the bottom plate surrounding the inlet opening is rounded and converges in the direction of water flow toward the turbine wheel.

6. A water-jet propulsion system as defined in claim 5 wherein the guide means is defined between the cover plate and a cover disk, a cylindrical section depending from the cover disk, and the upper end of said portion of the bottom plate being located within the cylindrical section.

7. A water-jet propulsion system as defined in claim 6 wherein the cover plate is annular in shape, and including reinforcement ribs on its upper surface.

8. A water-jet propulsion system as defined in claim 6 including a water-lubricated wire bearing between the upper end of said portion of the bottom plate and said cylindrical section.

9. A water-jet propulsion system as defined in claim 8 including felt seals above and below the wire bearing, the felt seals being permeable to water but not to dirt.

10. A water-jet propulsion system as defined in claim 1 including an annular gap between the periphery of the bottom plate and the lower end of the pressure housing, three radially-outwardly-springy packing rings projecting radially form the periphery of the bottom plate, and a wear resistant, rustproof cylindrical friction plate lining the lower end of the pressure housing, the packing rings engaging the friction plate.

11. A water-jet propulsion system as defined in claim 10 wherein each packing ring is discontinuous and includes a joint at which its two ends face each other, the joint of each packing ring being circumferentially offset from the joints of the other two packing rings.

12. A water-jet propulsion system as defined in claim 1 including a control shaft extending coaxially within the pressure housing, radial cross members connecting the lower end of the shaft to the bottom plate, the upper end of the shaft extending upwardly beyond the cover plate, and a drive mechanism for rotating the shaft and thereby rotating the bottom plate.

13. A water-jet propulsion system as defined in claim 13 including a power-transfer shaft for rotating the turbine wheel, the power-transfer shaft being hollow and the control shaft passing coaxially through it, and means for driving the power-transfer shaft, said driving means being located between the cover plate and the drive mechanism for the control shaft.

14. A water-jet propulsion system as defined in claim 13 including a tubular member though which the control shaft and the power-transfer shaft pass coaxially, a central opening in the cover plate within which the tubular member is mounted, and a housing fixed to, and extending above, the tubular member for enclosing the drive mechanism for the control shaft and the driving means for the power-transfer shaft.

15. A water-jet propulsion system as defined in claim 14 including bearing at each end of the tubular member, between the tubular member and the power-transfer shaft.

* * * * *